US012116237B1

(12) United States Patent
Ruffa et al.

(10) Patent No.: US 12,116,237 B1
(45) Date of Patent: Oct. 15, 2024

(54) TWISTLESS CABLE DEPLOYMENT DEVICE

(71) Applicant: The United States of America as represented by the Secretary of the Navy, Newport, RI (US)

(72) Inventors: Anthony A Ruffa, Hope Valley, RI (US); Brian K Amaral, Newport, RI (US)

(73) Assignee: The United States of America as Represented by the Secretary of the Navy

( * ) Notice: Subject to any disclaimer, the term of this patent is extended or adjusted under 35 U.S.C. 154(b) by 260 days.

(21) Appl. No.: 17/955,904

(22) Filed: Sep. 29, 2022

(51) Int. Cl.
*B65H 75/00* (2006.01)
*B65H 75/12* (2006.01)
*B65H 75/44* (2006.01)

(52) U.S. Cl.
CPC ..... *B65H 75/4405* (2013.01); *B65H 75/12* (2013.01); *B65H 75/4457* (2013.01); *B65H 75/4481* (2013.01); *B65H 2701/30* (2013.01)

(58) Field of Classification Search
CPC ..... B65H 75/4405; B65H 75/12; B65H 75/4457; B65H 75/4481; B65H 2701/30; A01K 89/01081; A01K 89/01142
See application file for complete search history.

(56) References Cited

U.S. PATENT DOCUMENTS

2023/0101660 A1* 3/2023 Niitsuma ..... A01K 89/01142 242/322

FOREIGN PATENT DOCUMENTS

| | | | | |
|---|---|---|---|---|
| CN | 110436279 A | * | 11/2019 | |
| CN | 112441475 A | * | 3/2021 | ..... B65H 75/38 |
| CN | 113264424 A | * | 8/2021 | |
| CN | 113979233 A | * | 1/2022 | |
| CN | 114194955 A | * | 3/2022 | |

* cited by examiner

*Primary Examiner* — Emmanuel M Marcelo
(74) *Attorney, Agent, or Firm* — James M. Kasischke; Michael P. Stanley; Jeffry C. Severson

(57) ABSTRACT

A twistless cable deployment apparatus is provided for deploying cable. The apparatus includes a level winder that can be joined to a winch. The level winder is in a fixed position relative to the cable winch. The level winder has a non-rotating fixed spool that stores the cable by wrapping the cable around the spool. A rotating base is disposed coaxially with the fixed spool and rotates around the axis of the fixed spool. A post is mounted on the rotating base, and a traveler is slidably mounted on the post. A traveling guide eye is joined to the traveler. By rotation of the rotating base, cable is deployed from the fixed spool. A primary guide eye can guide the cable to the winch.

16 Claims, 3 Drawing Sheets

TWISTLESS CABLE DEPLOYMENT DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

(1) Field of the Invention

The present invention is a method and apparatus for joining a cable between a fixed component (e.g., an equipment rack) and a rotating component (e.g., a winch).

(2) Description of the Related Art

Naval and commercial towed array systems can deploy thousands of feet of cable. The cables can be on the order of one inch in diameter and can be made of steel, para-aramid synthetic fiber or other materials. The cables can contain a plurality of optical fibers that are used both for sensing and telemetry. In conventional technology, an optical signal from a rotating winch is transmitted to a fixed fiber via an optical rotary joint. The optical rotary joint is incorporated into a slip ring that contains a plurality of optical and electrical channels. The slip ring maintains the connection between the fixed cable section on a ship or other platform and the rotating cable that is deployed using a winch.

Slip rings or fiber optic rotary joints work well for fibers that are used as telemetry channels because the signal to noise ratio is sufficiently high for purposes of telemetry. The signals can be amplified if necessary; however, amplification of the signals is expensive and the number of channels is limited. In addition, existing slip rings do not work as well for sensing components because the signals from the sensing components are typically very weak and often cannot be amplified.

A need exists for a cable deployment system that does not require a slip ring or fiber optic rotary joint.

BRIEF SUMMARY OF THE INVENTION

Accordingly, it is a primary object and general purpose of the present invention to provide an apparatus and method that can accommodate winch rotation while remaining connected to a fixed location, such as an equipment rack, without using a slip ring or fiber optic rotary joint.

To realize the objects and purposes of the invention, a twistless cable deployment apparatus includes a cable winch having an outer spool with a central longitudinal axis and an inner spool that is coaxial with the outer spool. A plurality of spokes join the outer spool to the inner spool such that the outer spool and the inner spool rotate together. Cable passes from an outer surface of the inner spool to an outer surface of the outer spool via an aperture in the outer spool. A level winder is mounted in a fixed position relative to the outer and inner spools. The cable passes from the level winder to the outer surface of the inner spool thereby enabling twistless deployment of the cable.

The level winder includes a non-rotating fixed spool having a central longitudinal axis. The non-rotating fixed spool stores the cable by wrapping the cable around an outer surface of the non-rotating fixed spool. A rotating base is disposed coaxially with the non-rotating fixed spool. The rotating base rotates around the central longitudinal axis of the non-rotating fixed spool and is driven by a motor. A post having a central longitudinal axis is mounted on the rotating base and the post rotates with the rotating base. The central longitudinal axis of the post is parallel to the central longitudinal axis of the non-rotating fixed spool. A traveler is slidably mounted on the post and movable axially along the post. A traveling guide eye is joined to the traveler and movable with the traveler. The cable passes from the non-rotating fixed spool through the traveling guide eye.

In one embodiment, a primary guide eye is fixed to the post and rotatable with the post and the cable passes from the traveling guide eye through the primary guide eye. In another embodiment, the primary guide eye is mounted to a fixed structure that does not rotate with the post and the cable passes from the traveling guide eye through the primary guide eye.

The cable may include electrical or fiber optic cables. The fiber optic cables may include a plurality of single mode and multi-mode optical fibers.

In one embodiment, the traveling guide eye is oriented at a non-zero angle with respect to the central longitudinal axis of the post.

A method of twistlessly deploying cable includes providing an apparatus including a cable winch with coaxial inner and outer spools and a level winder mounted in a fixed position relative to the inner and outer spools. The cable passes from the level winder to the outer surface of the inner spool. Cable is stored on a non-rotatable fixed spool of the level winder. The cable passes through a traveling guide eye of the level winder to a primary eye guide. The cable is directed from the primary guide eye to an outer surface of the inner spool and the cable is wound on the outer surface of the inner spool. The cable passes from the outer surface of the inner spool through an aperture in the outer spool to an outer surface of the outer spool. The cable is wound on the outer surface of the outer spool. A distal end of the cable is deployed from the outer surface of the outer spool.

During deployment of the cable, both the inner and outer spools rotate. Passing the cable through the traveling guide eye includes rotating a rotating base, a post and a traveler of the level winder to guide the cable off of the outer surface of the non-rotatable fixed spool.

In another embodiment, a twistless cable deployment apparatus includes a level winder but not inner and outer spools. In this embodiment the twistless cable deployment apparatus includes a non-rotating fixed spool having a central longitudinal axis. The non-rotating fixed spool stores the cable by wrapping the cable around an outer surface of the non-rotating fixed spool. The non-rotating fixed spool is mounted perpendicular to a fixed horizontal deck structure. A rotating base is disposed coaxially with the non-rotating fixed spool. The rotating base rotates around the central longitudinal axis of the non-rotating fixed spool and is driven by a motor. A post having a central longitudinal axis is mounted on the rotating base and the post rotates with the rotating base. The central longitudinal axis of the post is parallel to the central longitudinal axis of the non-rotating fixed spool. A traveler is slidably mounted on the post and movable axially along the post. A traveling guide eye is joined to the traveler and movable with the traveler. A primary guide eye may be fixed to and rotatable with the post or the primary guide eye may be mounted to a fixed structure that does not rotate with the post.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

The invention includes a cable deployment apparatus that accommodates winch rotation while remaining connected to a fixed location and eliminates the need for a conventional slip ring or fiber optic rotary joint.

A purpose of the invention is to eliminate slip ring losses and enable the use of more optical fibers than is possible in conventional systems that have a limited number of optical slip ring channels. Another purpose of the invention is to eliminate optical losses in telemetry systems and to enable the use of many more telemetry fibers than is possible with conventional technology. The improvement in telemetry systems can enable larger arrays and/or more bandwidth for existing arrays.

The invention includes a cable deployment device. The cable can be any kind of optical or electrical cable that would benefit from being deployed without using a slip ring or optical fiber rotary joint. In one embodiment, the cable is a fiber optic cable having a diameter on the order of 0.25 inches and containing a plurality of single mode and multimode fibers. Other types and sizes of cables may be used.

Figure 1:
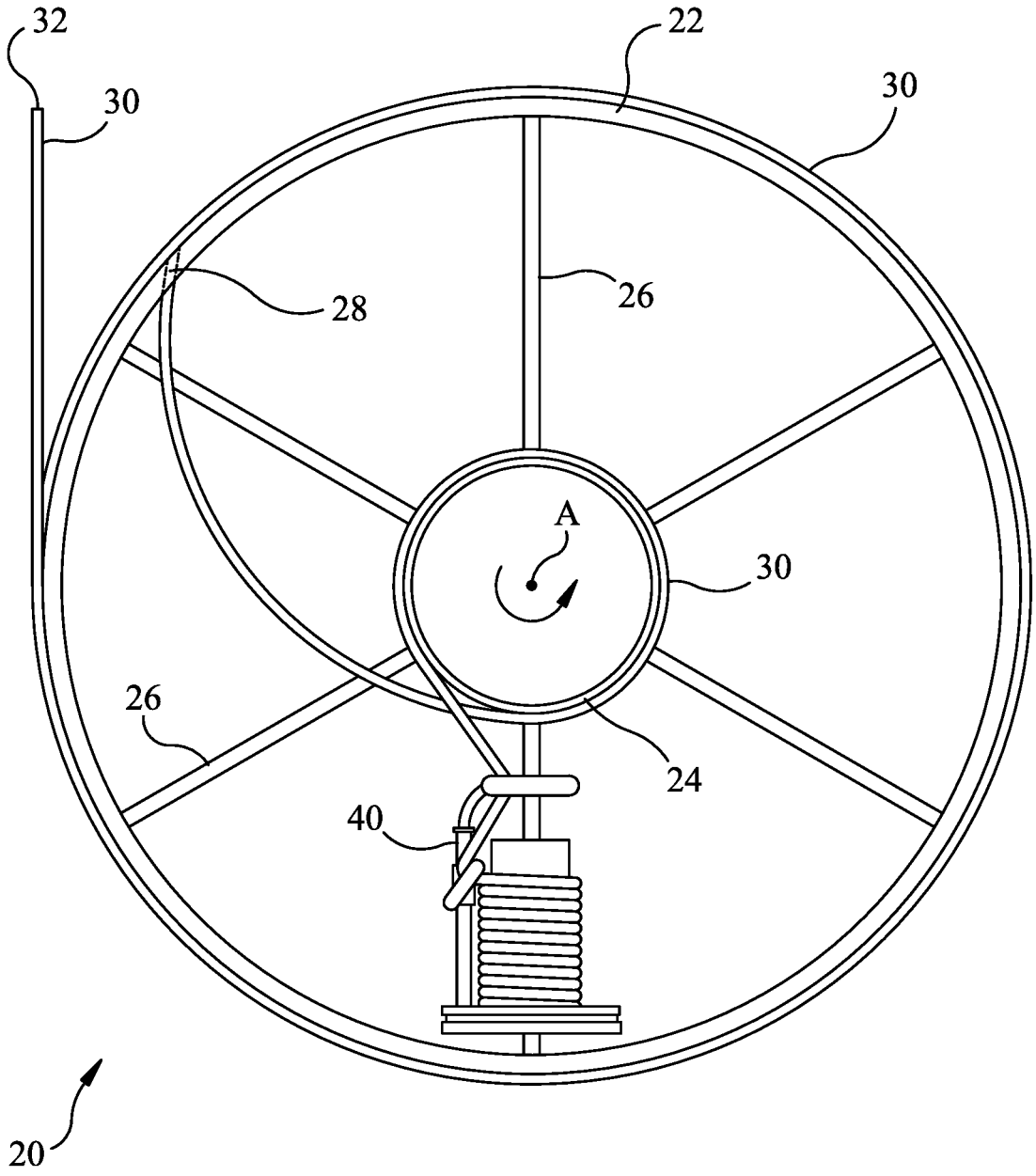
FIG. 1 illustrates a side view of one embodiment of a twistless cable deployment device.

FIG. 1 illustrates a side view of one embodiment of an apparatus 20 for deploying cable 30 having a distal end 32. Apparatus 20 deploys cable 30 without twisting the cable. Apparatus 20 includes a winch having an outer spool 22 and an inner spool 24. Outer spool 22 and inner spool 24 are coaxial around central longitudinal axis A. As depicted in FIG. 1, central longitudinal axis A is perpendicular to the plane of the drawing. Outer spool 22 is joined to inner spool 24 by a plurality of spokes 26. Inner spool 24 and outer spool 22 rotate together and are joined to a winch motor (not shown) for rotating the inner and outer spools. An aperture 28 is defined in outer spool 22 that allows communication of cable 30 from an outer surface of inner spool 24 to an outer surface of outer spool 22. A level winder 40 is mounted at a fixed position to allow cable 30 to run from the level winder to inner spool 24.

Figure 2:
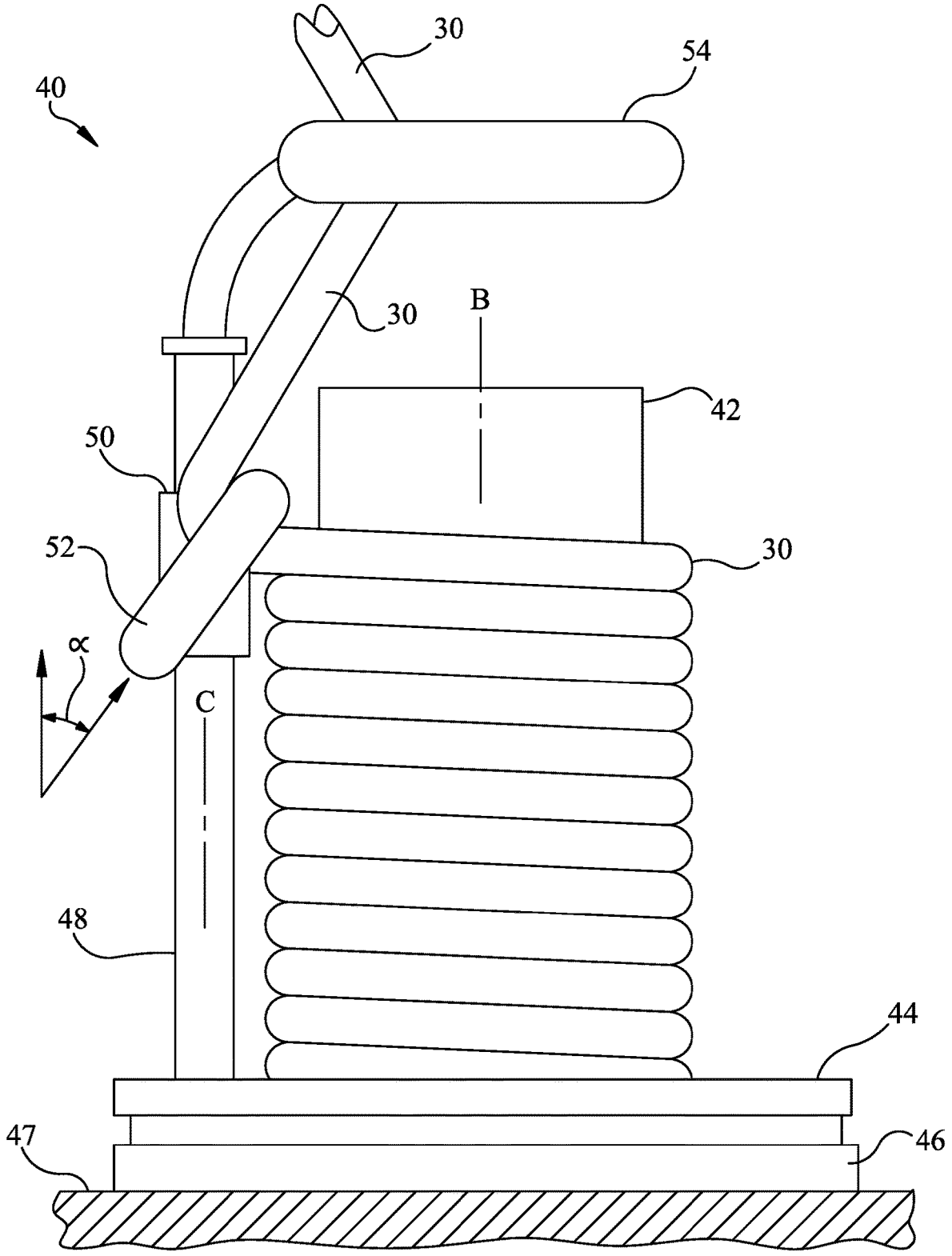
FIG. 2 illustrates an enlarged view of the level winder of the device shown in FIG. 1.

FIG. 2 illustrates an enlarged view of level winder 40 shown in FIG. 1. Level winder 40 includes a fixed spool 42 for storing cable 30 by wrapping the cable around the outer surface of the fixed spool. Fixed spool 42 does not rotate. A rotating base 44 is disposed coaxially around fixed spool 42 but is separate from fixed spool 42. Rotating base 44 rotates around a central longitudinal axis B of the fixed spool 42 and rotating base 44. A motor 46 is joined between rotating base 44 and a fixed structure 47 to rotate rotating base 44. Motor 46 can be any of many kinds of motors known in the art. Motor 46 can be joined to rotating base 44 with a gear train, chain, or other suitable connection. A post 48 is mounted on rotating base 44 and rotates with the rotating base. A central longitudinal axis C of post 48 is parallel to central longitudinal axis B of fixed spool 42. A traveler 50 (e.g., a bushing) is slidably fixed on post 48 and freely moveable axially along post 48. A traveling guide eye 52 is joined to traveler 50 and moves with the traveler. In one embodiment, traveling guide eye 52 is oriented at an angle $\alpha$ with respect to central longitudinal axis C of post 48 and central longitudinal axis B of fixed spool 42. In one embodiment, a bearing or similar device (not shown) may by inserted between traveling guide eye 52 and traveler 50 so that angle $\alpha$ of the traveling guide eye 52 changes as traveler 50 moves up and down post 48. A primary guide eye 54 is fixed to the post 48. In the embodiment shown in the FIGS., primary guide eye 54 rotates with post 48. However, in other embodiments, primary eye guide 54 can be immobile and mounted at a fixed position to a fixed structure.

Cable 30 is stored by winding it on fixed spool 42 of level winder 40. Cable 30 extends through traveling guide eye 52 to primary eye guide 54. The angle $\alpha$ of traveling guide eye 52 directs cable 30 under light tension to primary guide eye 54. At primary guide eye 54, cable 30 contacts an inner surface of an eye portion of primary guide eye 54. Cable 30 is redirected by primary guide eye 54 to the outer surface of inner spool 24. A portion of cable 30 is wound on the outer surface of inner spool 24. Cable 30 then extends between the outer surface of inner spool 24 and through aperture 28 in outer spool 22 to the outer surface of the outer spool. A portion of cable 30 is stored by winding on the outer surface of outer spool 22. A distal end 32 of cable 30 extends from outer spool 22 to be deployed.

During deployment of cable 30, outer spool 22 and inner spool 24 rotate together at the same rotational rate. Distal portion 32 of cable 30 rolls off of outer spool 22. Outer spool 22 retains and holds the tension of cable 30 via friction between cable 30 and the surface of the outer spool 22. The portion of cable 30 stored on outer spool 22 connects to the cable stored on inner spool 24 via aperture 28 in the outer surface of the outer spool. Cable 30 is provided to the outer surface of inner spool 24 by level winder 40. Rotating base 44 is rotated by motor 46 to move post 48, traveler 50 and traveling guide eye 52. As rotating base 44 rotates, traveling guide eye 52 guides cable 30 off of the outer surface of fixed spool 42. Traveling guide eye 52 retains contact with cable 30 during rotation. Traveling guide eye 52 imparts tensile forces to cable 30 that cause traveler 50 to translate axially along post 48 as the cable is being deployed. Axial translation of traveler 50 along post 48 causes traveling guide eye 52 to be near the portion of cable 30 being deployed from fixed spool 42. Cable 30 travels through primary guide eye 54 to the outer surface of inner spool 24.

During cable retrieval, retrieved cable 30 is wound onto the outer surface of outer spool 22. The most proximate portion of cable 30 on outer spool 22 travels through outer spool aperture 28 and is received on the surface of inner spool 24. The most proximate portion of cable 30 on inner spool 24 unspools through primary guide eye 54. Traveling guide eye 52 wraps cable 30 around fixed spool 42 as the traveling guide eye rotates on rotating base 44. Cable 30 already wrapped on fixed spool 42 guides the newly wrapped cable onto a free portion of fixed spool 42 because the free portion has a smaller diameter than the portion having cable already wrapped thereon.

In some embodiments, primary eye guide 54 can be joined to a fixed structure, if easier to construct. If desired, traveler 50 can be controlled and actuated to ensure that cable 30 is wound properly on fixed spool 42. Traveler 50 can also be controlled to allow winding of multiple layers of cable 30 on fixed spool 42. Level winder 40 can be oriented in one of many different directions. Level winder 40 can be oriented such that central longitudinal axis B of fixed spool 42 is horizontal or angled in any plane. Referring to FIGS. 1 and 2, central longitudinal axis B of fixed spool 42 may be normal to the plane of the drawings. Fixed spool 42 can be any length to allow storage of significant portions of cable 30. Traveling guide eye 52 and primary guide eye 54 can be other than eye-type bearing structures. For example, traveling guide eye 52 and primary guide eye 54 can be a variety of different bearings that are used to reduce friction with cables.

In another embodiment of the invention, a twistless cable deployment apparatus includes the level winder 40 of FIG. 2 but does not include the outer spool 22 or the inner spool 24. In this embodiment, the non-rotating fixed spool 42 is mounted perpendicular to a fixed horizontal deck structure, such as structure 47. As illustrated in FIG. 2, cable 30 is deployed directly from primary guide eye 54 without the use of outer and inner spools 22, 24. Primary guide eye 54 may be fixed to and rotatable with post 48 or the primary guide eye may be mounted to a fixed structure, such as structure 47.

Figure 3:
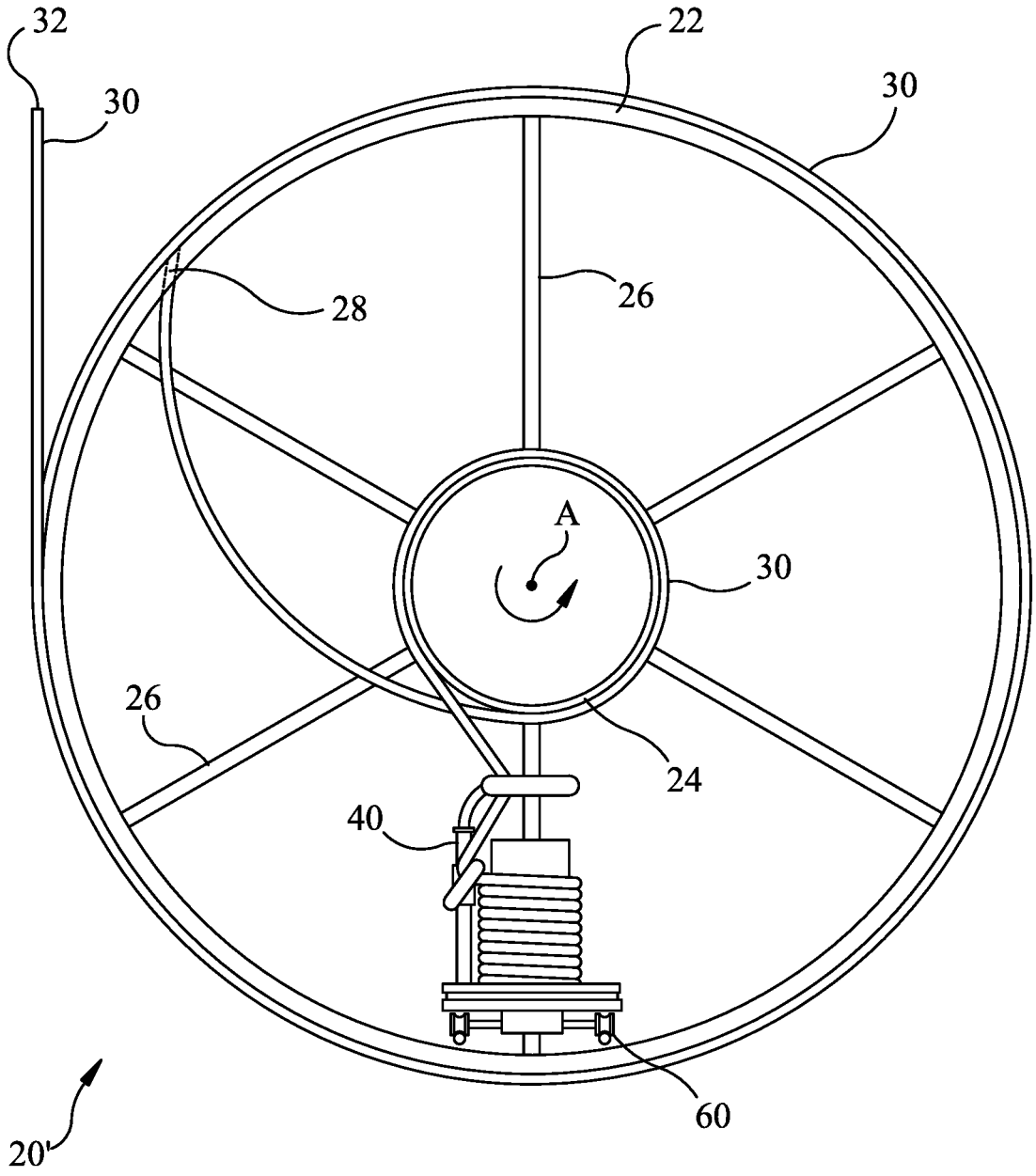
FIG. 3 illustrates an alternate embodiment of a twistless cable deployment device.

In another embodiment 20' shown in FIG. 3, the outer spool 22 and inner spool 24 are large in the profile direction. To accommodate the large width of the spools, the level winder 40 of FIG. 2 is mounted on a track system 60 to traverse the length of the inner spool 24 during deployment and retrieval as the cable diameter may be small relative to the large width of spools to accommodate long lengths of cable. Track system 60 could be a variety of systems that translate level winder parallel to the axis of inner spool 24.

In conventional technology, the optical slip ring is the primary bottleneck that prevents improvements in performance for towed array systems that rely on fiber optics for sensing and/or telemetry. The invention can lead to significant improvement because slip ring losses are eliminated and more fibers can be used. The elimination of slip ring losses and the use of more fibers is not possible in conventional systems that have a limited number of optical slip ring channels. For telemetry systems, the invention also eliminates optical losses. The invention can also support many more telemetry fibers than is possible with conventional technology. The improvement in telemetry systems can enable larger arrays or more bandwidth for existing arrays.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A twistless cable deployment apparatus comprising:

a non-rotating fixed spool having a central longitudinal axis wherein the non-rotating fixed spool stores cable by wrapping the cable around an outer surface of the non-rotating fixed spool;

a rotating base disposed coaxially with said non-rotating fixed spool wherein said rotating base rotates around said central longitudinal axis of said non-rotating fixed spool;

a post having a central longitudinal axis and mounted on said rotating base wherein said post rotates with said rotating base, said central longitudinal axis of said post being parallel to said central longitudinal axis of said non-rotating fixed spool;

a traveler slidably mounted on said post and movable axially along said post; and a traveling guide eye joined to said traveler and movable with said traveler wherein said cable passes from said non-rotating fixed spool through said traveling guide eye.

2. The apparatus of claim 1, further comprising a primary guide eye fixed to said post and rotatable with said post wherein cable passes from said traveling guide eye through said primary guide eye.

3. The apparatus of claim 1, wherein the apparatus is mounted to a fixed structure and further comprising a primary guide eye mounted to said fixed structure wherein said cable passes from said traveling guide eye through said primary guide eye.

4. The apparatus of claim 1, wherein said traveling guide eye is oriented at a non-zero angle with respect to said central longitudinal axis of said post.

5. The apparatus of claim 1, further comprising a motor joined to said rotating base to rotate said rotating base.

6. The apparatus of claim 1, wherein said traveler is actuated to move axially to a position on said post.

7. A twistless cable deployment apparatus comprising:

a cable winch having an outer spool with a central longitudinal axis and an inner spool that is coaxial with said outer spool;

a plurality of spokes that join said outer spool to said inner spool wherein said outer spool and said inner spool rotate together;

an aperture defined in said outer spool through which cable passes between an outer surface of said inner spool and an outer surface of said outer spool; and a level winder mounted in a fixed position relative to said outer and inner spools wherein said cable passes from said level winder to said outer surface of said inner spool thereby enabling twistless deployment of said cable.

8. The apparatus of claim 7, wherein said level winder comprises:

a non-rotating fixed spool having a central longitudinal axis wherein said non-rotating fixed spool stores cable by wrapping cable around an outer surface of said non-rotating fixed spool;

a rotating base disposed coaxially with said non-rotating fixed spool wherein said rotating base rotates around said central longitudinal axis of said non-rotating fixed spool;

a post having a central longitudinal axis and mounted on said rotating base wherein said post rotates with said rotating base, said central longitudinal axis of said post being parallel to said central longitudinal axis of said non-rotating fixed spool;

a traveler slidably mounted on said post and movable axially along said post; and a traveling guide eye joined to said traveler and movable with said traveler wherein said cable passes from said non-rotating fixed spool through said traveling guide eye.

9. The apparatus of claim 8, further comprising a primary guide eye fixed to said post and rotatable with said post wherein cable passes from said traveling guide eye through said primary guide eye.

10. The apparatus of claim 8, further comprising a primary guide eye mounted to a fixed structure that does not rotate with said post wherein said cable passes from said traveling guide eye through said primary guide eye.

11. The apparatus of claim 8, further comprising a motor joined to said rotating base to rotate said rotating base.

12. The apparatus of claim 8, wherein said traveling guide eye is oriented at a non-zero angle with respect to said central longitudinal axis of said post.

13. The apparatus of claim 7, further comprising a translation system joined to said level winder, said translation system being capable of translating said level winder parallel to the axis of said cable winch.

14. A method of twistlessly deploying cable comprising:

providing an apparatus including a cable winch having an outer spool with a central longitudinal axis and an inner spool that is coaxial with said outer spool, and a level winder mounted in a fixed position relative to the outer and inner spools wherein cable passes from the level winder to a surface of the inner spool;

storing cable on a non-rotatable fixed spool of the level winder;

passing cable through a traveling guide eye of said level winder to a primary eye guide;

directing cable from the primary guide eye to an outer surface of the inner spool and winding cable on an outer surface of the inner spool;

passing cable from the outer surface of the inner spool through an aperture in the outer spool to an outer surface of the outer spool and winding cable on the outer surface of the outer spool; and deploying a distal end of the cable from the outer surface of the outer spool.

15. The method of claim 14, wherein the step of deploying includes rotating both the inner spool and the outer spool.

16. The method of claim 15, wherein the step of passing the cable through the traveling guide eye includes rotating a rotating base, a post and a traveler of the level winder to guide the cable off of the outer surface of the non-rotatable fixed spool.

* * * * *